US007228802B2

(12) United States Patent
Montefusco

(10) Patent No.: US 7,228,802 B2
(45) Date of Patent: Jun. 12, 2007

(54) REUSEABLE PROJECTILE

(76) Inventor: Vincent Montefusco, P.O. Box 387, Mammoth Lakes, CA (US) 93546

( * ) Notice: Subject to any disclaimer, the term of this patent is extended or adjusted under 35 U.S.C. 154(b) by 0 days.

(21) Appl. No.: 11/145,581

(22) Filed: Jun. 6, 2005

(65) Prior Publication Data

US 2006/0276277 A1 Dec. 7, 2006

(51) Int. Cl.
*F42B 8/12* (2006.01)

(52) U.S. Cl. ..... 102/529; 102/501

(58) Field of Classification Search ..... 102/501, 102/529; D21/452, 707; D22/115, 116; 473/578, 579, 582, 585, 613; 446/56
See application file for complete search history.

(56) References Cited

U.S. PATENT DOCUMENTS

| | | | | | |
|---|---|---|---|---|---|
| 2,213,637 | A * | 9/1940 | Osgood | 473/585 |
| 2,611,999 | A * | 9/1952 | Mikolay | 446/400 |
| 2,629,600 | A * | 2/1953 | Edmonds | 473/585 |
| RE25,279 | E * | 10/1962 | Crockford et al. | 604/130 |
| 3,528,695 | A * | 9/1970 | Peters | 292/336.3 |
| 5,112,053 | A * | 5/1992 | Brucker | 473/238 |
| 5,112,062 | A * | 5/1992 | Pratt | 473/585 |
| 5,915,694 | A * | 6/1999 | Brum | 273/359 |
| 6,159,117 | A * | 12/2000 | Chan | 473/574 |
| 6,726,580 | B2 * | 4/2004 | Peterson | 473/570 |
| 6,752,682 | B1 * | 6/2004 | Ferrell | 446/230 |
| 2003/0027672 | A1 * | 2/2003 | Leal et al. | 473/613 |

FOREIGN PATENT DOCUMENTS

GB 2097685 A * 11/1982

* cited by examiner

*Primary Examiner*—Michael J. Carone
*Assistant Examiner*—Bret Hayes
(74) *Attorney, Agent, or Firm*—Irving Keschner

(57) ABSTRACT

A projectile comprising a shaft hollowed at one end with a male thread at the outer, or head, end. A plurality of fins are secured around the circumference adjacent the first shaft end or base, the fins being slightly canted to cause the projectile to spin as it leaves the launcher. A soft foam head is attached to the threaded end of the shaft. In a first embodiment, a hollow tip is removably attached to the head; in an alternate embodiment, the removable tip is made of a solid foam material.

4 Claims, 2 Drawing Sheets

12
12'
16
18
20
22
24
26
28
28'
7
8
9

REUSEABLE PROJECTILE

BACKGROUND OF THE INVENTION

1. Field of the Invention

The present invention relates to projectiles and in particular, to a training projectile that is adapted for use with a hollow tip filled with various effect materials or in another version, a foam filled tip.

2. Description of the Prior Art

Projectiles used for training purposes to simulate a service projectile have been available in the prior art. For example, U.S. Pat. No. 6,123,289 to Manole et al, discloses a training projectile having a flange and flared section to provide improved decay and high drag; thus limiting projectile flight and descent to a predetermined range.

The projectile disclosed in the '289 patent is not reusable after being fired and is designed exclusively to be used with an explosive charge.

What is desired is to provide a training projectile that has multiple functions and can be reused if necessary.

SUMMARY OF THE INVENTION

The present invention provides a projectile for use with various launchers and guns for training law enforcement, military and private company personnel. In addition, the projectile of the present invention can be used as a distraction device and modified to function in a non-training mode to cause damage to a target object. If the tip, head or main shaft of the projectile is damaged, a replacement part can be installed inexpensively and rapidly, allowing the projectile to be reused.

The projectile comprises a shaft hollowed at one end with a male thread at the outer, or head, end. The shaft fits over a high pressure gas-gun barrel using blanks. A plurality of fins are secured around the circumference adjacent the first shaft end or base, the fins being slightly canted to cause the projectile to spin as it leaves the launcher. A soft foam head is attached to the threaded end of the shaft. The foam head prevents gas leaks from the high pressure gas launcher and prevents damage to the target object. In a first embodiment, a hollow plastic tip containing various materials that cause a predetermined effect after hitting an object is removably attached to the head. In an alternate embodiment, the tip comprises a soft foam material.

The present invention allows a projectile, used for training purposes or otherwise, to be repaired and reused if the main shaft, tip or head is damaged, thus reducing the cost of maintaining an arsenal of such projectiles.

DESCRIPTION OF THE DRAWINGS

For a better understanding of the present invention as well as other objects and further features thereof, reference is made to the following description which is to be read in conjunction with the accompanying drawing therein.

DESCRIPTION OF THE INVENTION

Figure 1:
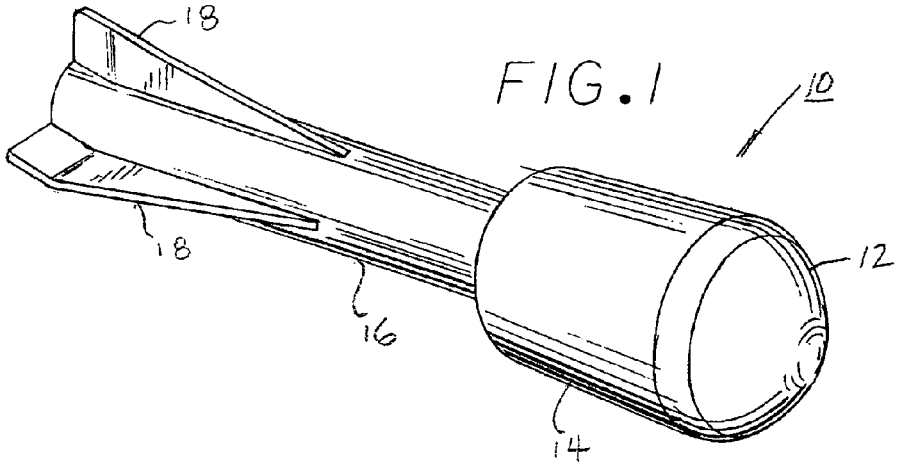
FIG. 1 is a perspective view of the training projectile of the present invention.
Figure 2:
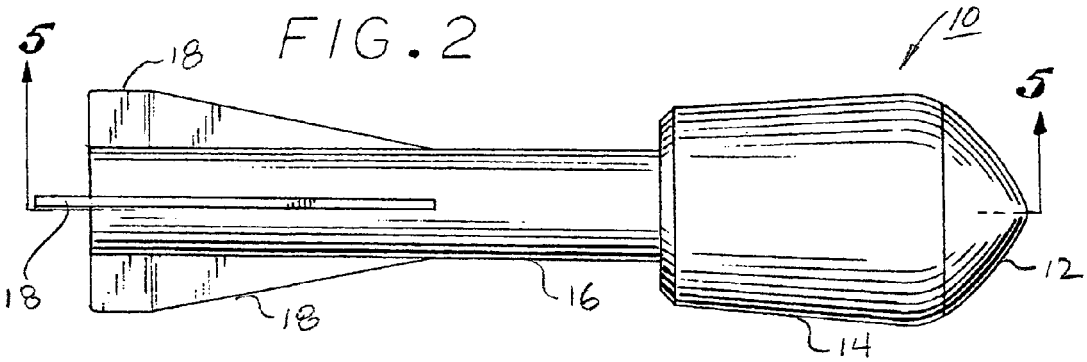
FIG. 2 is a side view of the projectile shown in FIG. 1.
Figure 3:
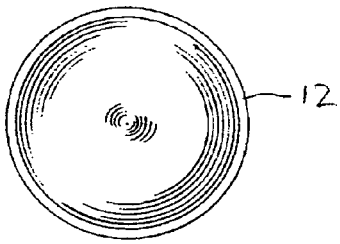
FIG. 3 is a front view of the projectile shown in FIG. 1.
Figure 4:
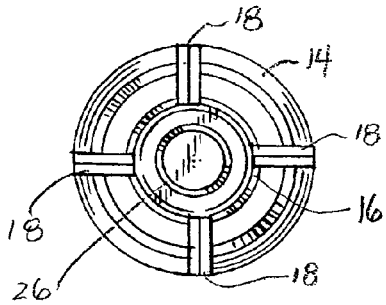
FIG. 4 is a rear view of the projectile shown in FIG. 1.

Referring now to the FIGS. 1–4, the projectile 10 of the present invention is illustrated. Projectile 10 comprises a tip 12, head portion 14, shaft 16 and fins 18.

Shaft 16 preferably is fabricated from plastic, is thin walled and light weight and hollowed at end 20 and has male thread 22 formed on the head end 24. An insert 26 is positioned within the hollow portion of shaft 16 at the bottom, or tail, end thereof and is provided to receive, in the embodiment illustrated, a toy model rocket engine propellant, insert 26 also acting to prevent the engine from falling from shaft 16. Alternately, projectile 10 can be mounted, for example, on the barrel of a paintball gun or a modified gun barrel when blank bullets (or cartridges) are utilized. In addition, the projectile can be positioned with a $CO_2$ launcher; when the launcher trigger is pulled, $CO_2$ gas is released which forces the projectile from the launcher. In essence, projectile 10 can be launched using a variety of techniques.

Fins 18, preferably made of soft foam, are mounted to and equally spaced and positioned around the circumference of main shaft 16 at the base end. Fins 18 are designed to fit inside a high pressure gas launcher to provide stability to the rear of the projectile as it is launched and are slightly canted (preferably at approximately 5 degrees) at the rear end to spin the projectile once it leaves the launcher. The spin greatly increases the speed, distance and target accuracy of projectile 10. The fins 18 are typically glued in place; however, slots can be formed in the surface of shaft 16 and fins secured therewithin.

Tip 12, in one embodiment, is fabricated of hollow plastic and has a threaded female opening 28 formed therein. Tip 12 can contain, but is not limited to, a variety of chemicals and other materials so when tip 12 hits an object, an effect is produced. Tip 12 can contain high viscosity colored marking paint (similar to paintball guns), spark/flash explosives powder charge, flash/bang explosives powder charge, fragmentation explosives powder charge, colored water and a non explosives powder (similar to baby powder). Male thread 22 screws into opening 28 thus removably securing tip 12 to shaft 16.

Figures 5, 6, 7, 8, 9, 10:
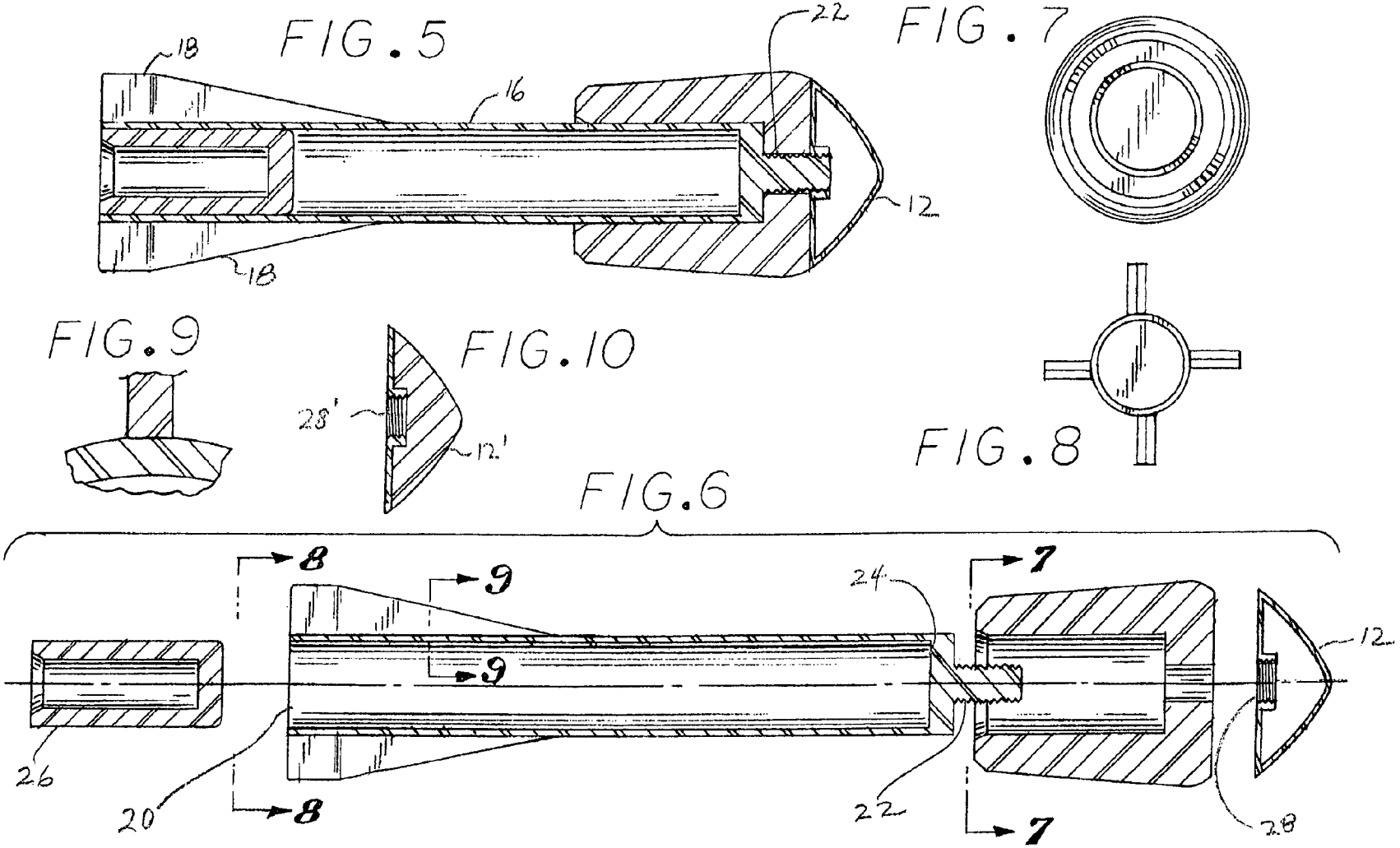
FIG. 5 is a cross-sectional view along line 5—5 of FIG. 2.
FIG. 6 is an exploded view of the device shown in FIG. 5.
FIG. 7 is an end view of the head portion showing the chamber around the tube opening.
FIG. 8 is an end view of the tube portion showing the inside diameter for receiving the engine.
FIG. 9 is a cross-sectional view along line 9—9 of FIG. 6 illustrating the flat spot on the tube outer surface.
FIG. 10 is a sectional view of a solid foam head portion.

In an alternate version, a soft foam tip 12', as shown in FIG. 10, can be utilized to prevent damage to objects, people or animals. The female thread 28' screws onto shaft male thread 22 and removably secures the soft foam tip 12' to shaft 16. The female thread also keeps the material inside of tip 12' from spilling out. The user can place some glue on the threads for permanent placement if necessary.

Head 14, preferably made of soft foam, and is secured in place as tip 12 is screwed onto male thread 22. Head 14 adds weight and stability to projectile 10 in flight. Head 14 also adds a tip cushion effect when a target is hit. If a high pressure gas launcher is utilized, head 14 functions to keep the gas from escaping (tight seal inside of the launcher tube wall) around the head which helps provide more speed, distance and accuracy to projectile 10 then if it fit inside of the launcher loosely allowing gas to escape around it.

Utilizing a removable tip allows the purchaser of projectile 10 to easily replace tips having specific characteristics without the necessity of purchasing the entire projectile unit.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A projectile comprising:

a shaft having a longitudinal axis and having first and second ends, an exterior surface and a threaded member attached to said second end of said shaft, said shaft having a hollow area at said second end for receiving an insert;

a propellant positioned within said insert to launch said projectile when said propellant is activated;

a plurality of fins secured to the exterior surface of said shaft adjacent said first end of said shaft member;

a head member having first and second internal recesses, said shaft extending into said first recess whereby said threaded member extends through said second recess; and a tip member having an internal threaded recess for removably receiving said threaded member whereby said tip is coupled to said shaft, said tip member containing a material which produces an observable effect when the tip strikes an object.

2. The projectile of claim 1 wherein said tip comprises a hollow plastic member containing a material which produces an audio effect when the tip strikes an object.

3. The projectile of claim 1 wherein said tip comprises a hollow plastic member containing a material which produces a visual effect when the tip strikes an object.

4. A projectile apparatus comprising:

a projectile member having a shaft having a longitudinal axis and having first and second ends, an exterior surface and a threaded member attached to said first end of said shaft, a plurality of fins secured to the exterior surface of said shaft adjacent said first end of said shaft member, a head member having first and second internal recesses, said shaft extending into said second recess whereby said threaded member extends through said second recess, a tip member having an internal threaded recess for removably receiving said threaded member whereby said tip is coupled to said shaft, said tip member containing a material which produces an observable effect when the tip strikes an object, and;

propellant means for launching said projectile member in order to strike a remote object.

* * * * *